US006012628A

United States Patent [19]

Shaikh et al.

[11] Patent Number: 6,012,628

[45] Date of Patent: Jan. 11, 2000

[54] PROTECTIVE BOX FOR A FOOD TRAY

[75] Inventors: Mahmood A. Shaikh, Cincinnati, Ohio; Andreas Christel, Piscataway, N.J.

[73] Assignee: Lawson Mardon Thermaplate Corporation, Piscataway, N.J.

[21] Appl. No.: 08/855,600

[22] Filed: May 13, 1997

Related U.S. Application Data

[60] Provisional application No. 60/017,305, May 13, 1996.

[51] Int. Cl.[7] ..... B65D 5/00

[52] U.S. Cl. ..... 229/103.2; 229/906; 229/186; 206/434; 206/495

[58] Field of Search ..... 229/103.2, 902, 229/906, 186; 206/434, 495, 784, 485, 223, 541, 756; 426/124

[56] References Cited

U.S. PATENT DOCUMENTS

| | | | |
|---|---|---|---|
| 936,986 | 10/1909 | Conley | 229/186 X |
| 3,324,999 | 6/1967 | Farquihar | 229/103 X |
| 3,658,235 | 4/1972 | Katzenmayer et al. | 229/902 X |
| 3,659,773 | 5/1972 | Manizza | 229/902 X |
| 3,705,681 | 12/1972 | Rossi et al. | 229/103.2 |
| 4,313,540 | 2/1982 | Hart et al. | 229/784 X |
| 4,919,326 | 4/1990 | Deiger | 229/906 X |
| 5,092,467 | 3/1992 | Elward | 229/103.2 X |
| 5,197,657 | 3/1993 | Cassidy et al. | 229/103.2 |
| 5,522,504 | 6/1996 | Levi | 229/103.2 |
| 5,540,381 | 7/1996 | Davis | 229/103.2 |

*Primary Examiner*—Gary E. Elkins
*Assistant Examiner*—Tri M. Mai
*Attorney, Agent, or Firm*—Venable; John W. Schneller; Michael A. Sartori

[57] ABSTRACT

A protective box for a food tray. The food tray has a base, a generally upright, contiguous wall attached to the base, and a circumferential flange attached to an upper edge of the wall. The protective box typically has three or more, generally upright walls, and a device for holding the food tray within the box so that the flange of the food tray is separated from at least two of the upright walls of the protective box.

3 Claims, 18 Drawing Sheets

PROTECTIVE BOX FOR A FOOD TRAY

This application claims benefit of provisional application Ser. No. 60/017,305 filed May 13, 1996.

BACKGROUND OF THE INVENTION

The present invention relates to a protective box for a food tray.

In the frozen food industry, food trays are used to supply frozen foods to the consumer. The food tray usually has a rectangular, semi-rectangular, oblong, round or obround shape, and is composed of solid or foamed plastic material. Further, the tray is provided with a bottom, and one or more, contiguous upright sides. At an upper end of the upright sides is a flange, which is typically relatively brittle and fragile.

Typically, the food tray is shipped within a known, straight wall box. However, this known box (typically referred to as a "sealed end box") is simply a rectangular box that has a closeable end through which the food tray is inserted. These boxes provide little protection for the tray itself, and as will be described, during the shipping process the tray is in need of protection.

In the known sealed end box, should the box and tray be dropped, the edges of the tray flange will come into contact with the walls of the box, thus subjecting the tray flange to a sharp impact. This is because there is only thin layers of cardboard between the tray flange and the ground. Thus, it is possible that the tray will break.

Through extensive abuse testing, it has been discovered that each tray has critical areas where breaks typically occur. These critical areas depend on the tray design and are often around the tray flange, stacking features, or around compartment dividers. Tray designs with different length sides may have different susceptability to breakage. In fact, during abuse testing with the known sealed-end box, with a particular design, the tray flange typically breaks about 90% of the time along a short side, as opposed to about 10% of the time along a long side. One reason for this difference in breakage rates is that when the box and tray are dropped, the force is more concentrated during an impact along the short side, than with an impact that may occur on the long side of the box and tray.

The path of the food tray from the processor plant to the consumer is as follows. The food trays are typically filled with the food at the food processor plant, then sealed with a transparent cover. The tray is then pushed into a carton (typically a sealed end box), which is subsequently closed.

The carton is next passed through a freezer. Most commonly used in the industry are freezers in which the boxes are passed in sequence through the freezer, with one box slowly pushing the next box through. The boxes and their contents are frozen down to −40° F.

Next, the frozen boxes and their contents are placed in shipping cartons, which typically contain from between 6 to 12 individual portions. The shipping cartons are then shipped to a distribution center, and then to the supermarket.

At the supermarket, the boxes are stacked and stored, and eventually placed in the freezer section of the supermarket for purchase by the consumer. In the supermarket freezer, the boxes are typically stored at about 0° F.

The consumer, while at the store, may pick up the box, and carelessly handle the box. Assuming the box and its contents are purchased by the consumer, the consumer may additionally mishandle the box at home.

As is apparent from the foregoing process, there is a good chance that the box may be dropped during its travels from the food processor plant to the consumer. If the tray within the box should get damaged, the consumer will likely return the product to the store of purchase, where it will be sent back to the seller.

Typically, tray breakage can show up in two different forms. First, and most apparent, the tray can be broken so that its contents are no longer adequately held. However, since the flange of the tray abuts up against the wall of the box, usually it is the tray flange that breaks. This may result in the flange chipping, with a portion of the flange falling into the food, where it may be subsequently consumed by the consumer. As is apparent, this could possibly cause an injury once consumed.

Although the flange of the tray is susceptible to breakage, the flange is an essential component of most food trays, so that the problem of broken flanges cannot be eliminated by replacing the tray having a flange with a tray that does not have a flange. For example, the flange provides a surface to which the lid can be connected to, or that the covering film or foil can be adhered to.

Further, the flange provides support for the tray. Without the flange, the tray would become flimsy, and unsuitable for its task of holding food.

Moreover, the flange provides a location that can be held onto by the user, for example, after the food in the tray is cooked.

Thus, although the shape of the flange can be changed, for example, from wide to narrow, or from flat to round, flanges are unlikely to disappear from the tray industry in the near future.

Another alternative to help reduce the problem of breakage would be to redesign the tray. However, this would require changing the automated assembly line to accommodate the redesigned trays, and require retooling at the tray manufacturing plant to manufacture the redesigned tray. Of course, such an endeavor would be expensive. Further, the redesigned tray would still be subjected to breakage in certain situations.

Additionally, it may be possible to manufacture the tray from a material other than plastic. However, plastic trays have evolved from aluminum trays, and are popular because they are microwavable, whereas aluminum trays are usually not. Further, plastic trays are in widespread use, and their complete replacement with an alternative medium in the near future is slight.

Furthermore, the current trend in the food processing industry is toward using even lighter and more inexpensive trays, such as trays comprised of foam. Although the foam trays are cheaper to manufacture, and up to 40% lighter than their counterparts, foam trays are weaker, and more susceptible to breakage. Thus, foam trays are even less suitable for use in the conventional sealed end box than other plastic trays.

Furthermore, trays made of recycled materials are being increasingly used. However, similar to the foam trays, trays made of recycled materials usually have a high breakage rate.

SUMMARY OF THE INVENTION

It is an object of the present invention to provide a protective box for a food tray that will keep the flanges of the food tray separated from the outer walls of the box, so that if the box and tray combination is dropped, the walls or base of the tray in its least critical areas, rather than the tray flange or other critical areas, absorbs the impact.

It is yet another object of the present invention to provide a box for a food tray that protects the tray against breakage, is inexpensive and easy to manufacture, and easy to ship and store.

It is another object of the present invention to provide a box for a food tray that can be used with existing automated systems, with a minimum of modifications.

It is further object of the present invention to provide a protective box for a food tray that will reduce breakage of the food tray to a maximum of 10% using conventional abuse testing.

It is another object of the present invention to provide a new, original, and ornamental design of a protective box for food trays.

The above and other objects are accomplished according to the invention by the provision of providing a protective box that includes means for holding a food tray flange away from the side walls of the box. The means creates a buffer zone between the flange of the tray and the sides of the box, so that the tray is not supported along its flange.

Preferably, the protective box provides support over a large surface area of the tray, in a region of either the side walls of the tray, or the base of the tray. Thus, if the box and tray are dropped, the impact will be distributed over a large surface area of the tray, so that the force is not directed against any one particular location, thus reducing the chance of breakage.

The invention will be described below in greater detail in connection with embodiments thereof that are illustrated in the drawing figures.

DETAILED DESCRIPTION OF THE INVENTION

Referring to FIGS. 1–8, a first embodiment of the present invention is illustrated. In this embodiment, the box 6 is formed by a rectangular bottom 10, and four side walls. As shown, two oppositely located side walls 12 have a length that is greater than a length of the other two oppositely located side walls 14.

Figure 1:
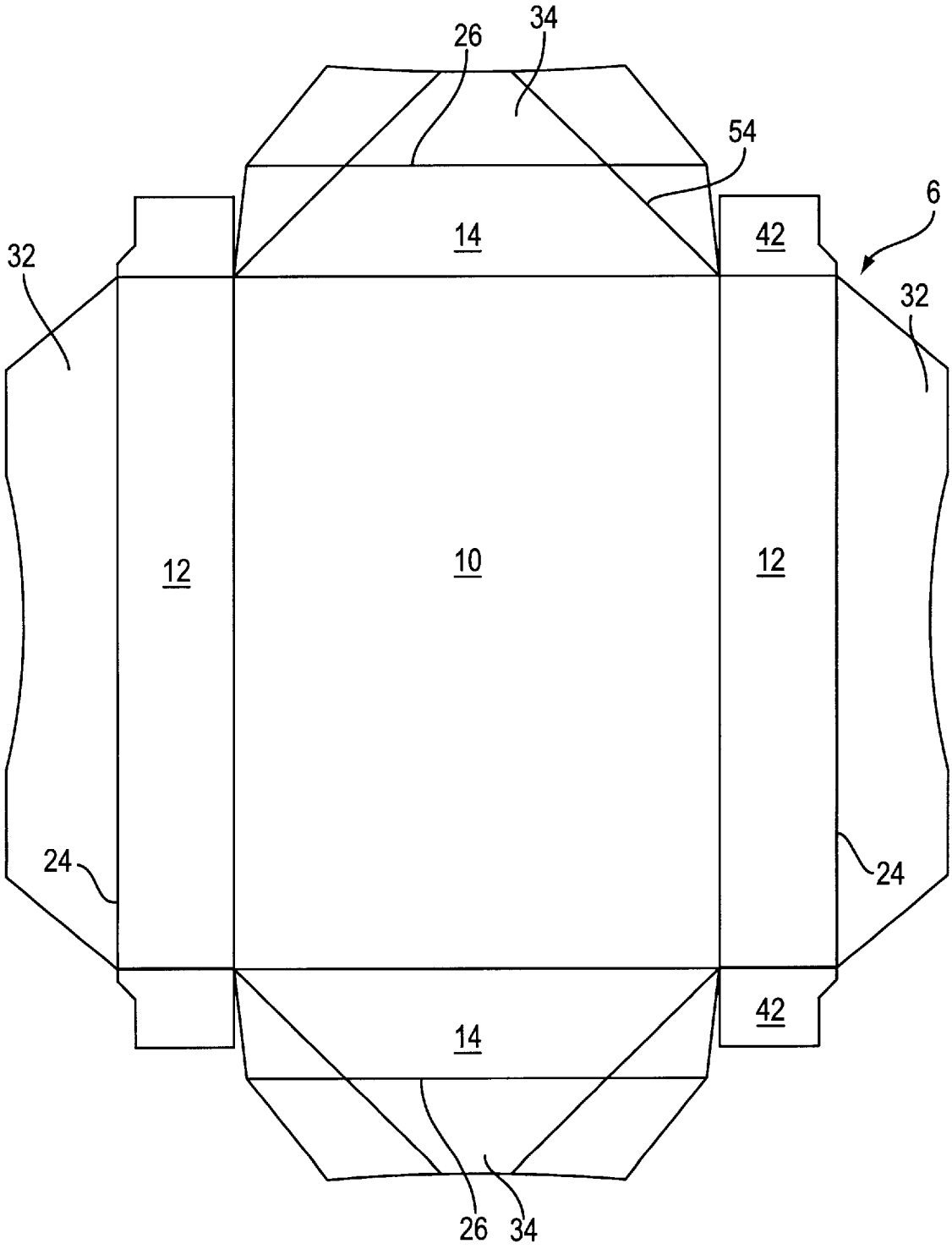
FIG. 1 illustrates a first embodiment of the present invention, with the protective box being shown in its unassembled condition.
Figure 2:
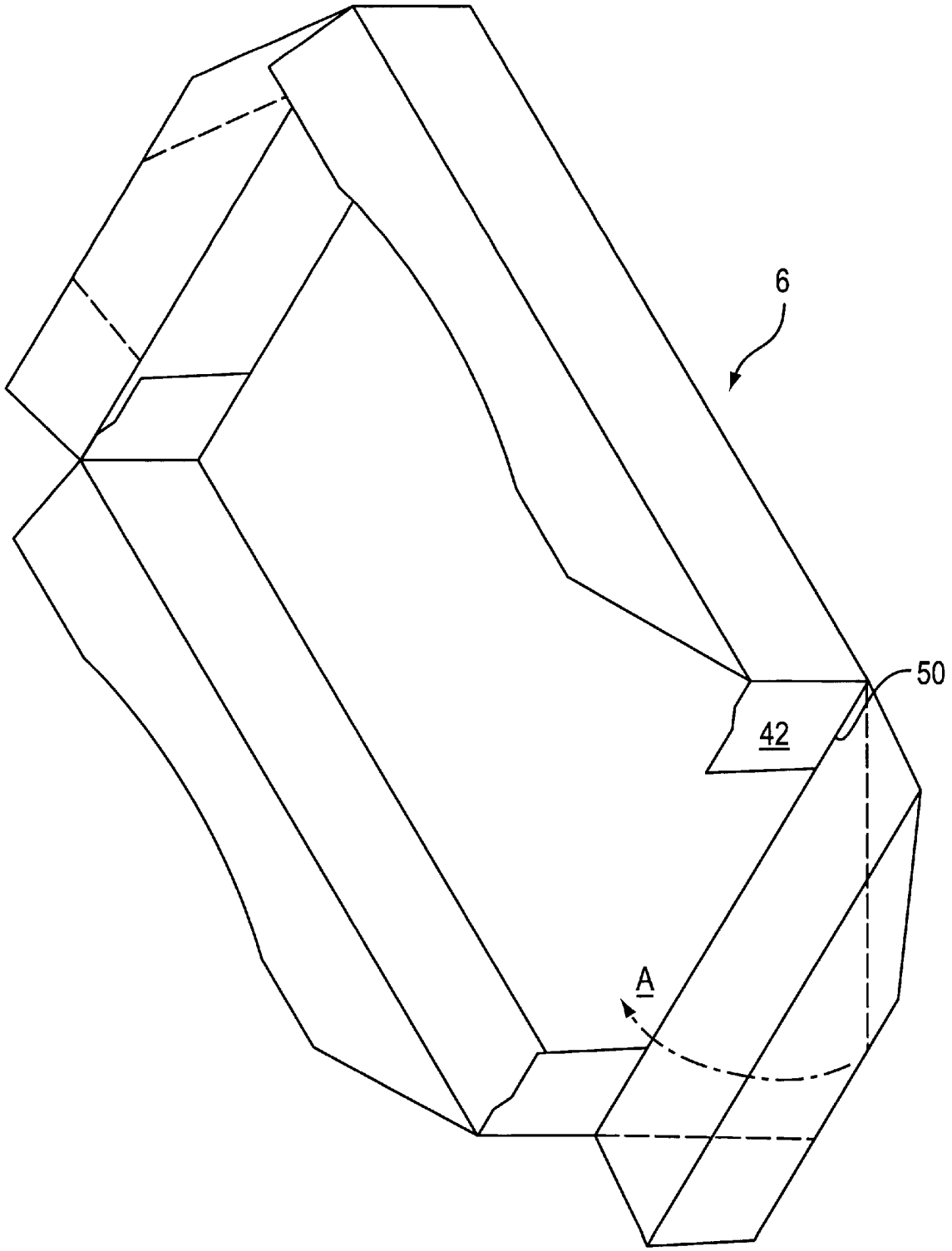
FIG. 2 is a perspective illustration of the embodiment shown in FIG. 1, with the protective box in a partially assembled condition.
Figure 3:
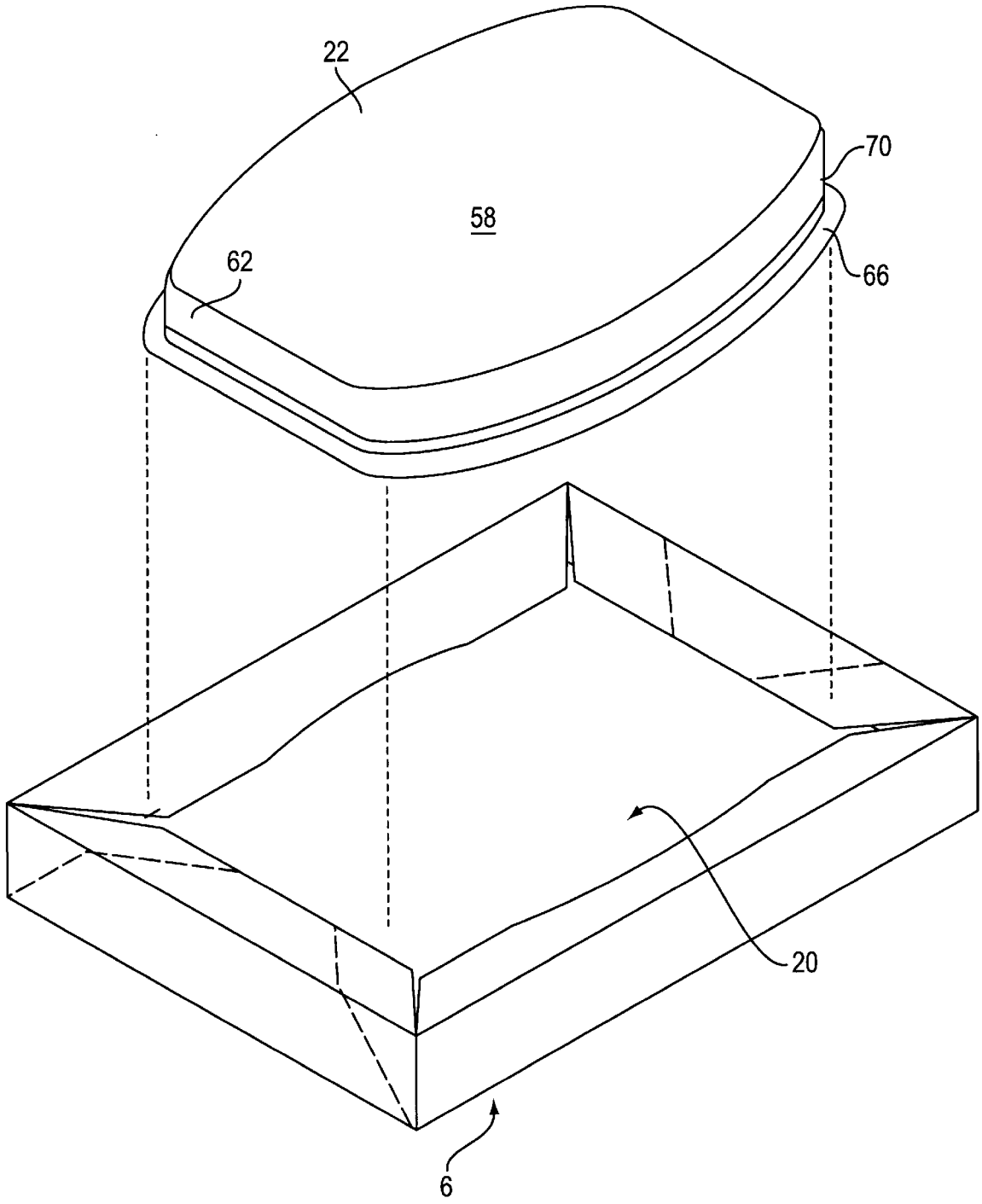
FIGS. 3 and 4 are perspective illustrations of the embodiment shown in FIG. 1, with the assembled protective box being used in conjunction with a food tray.
Figure 4:
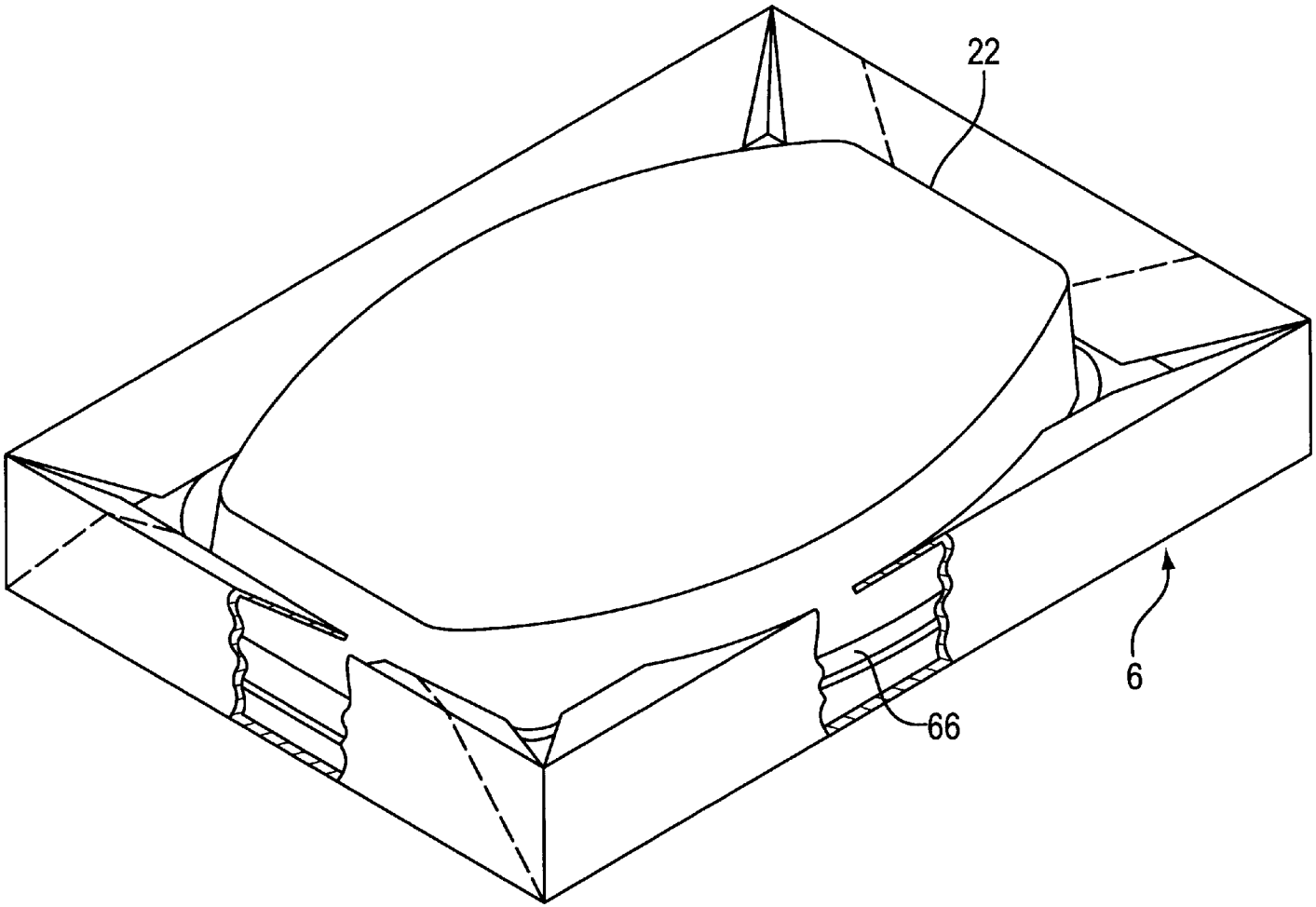
Figure 5:
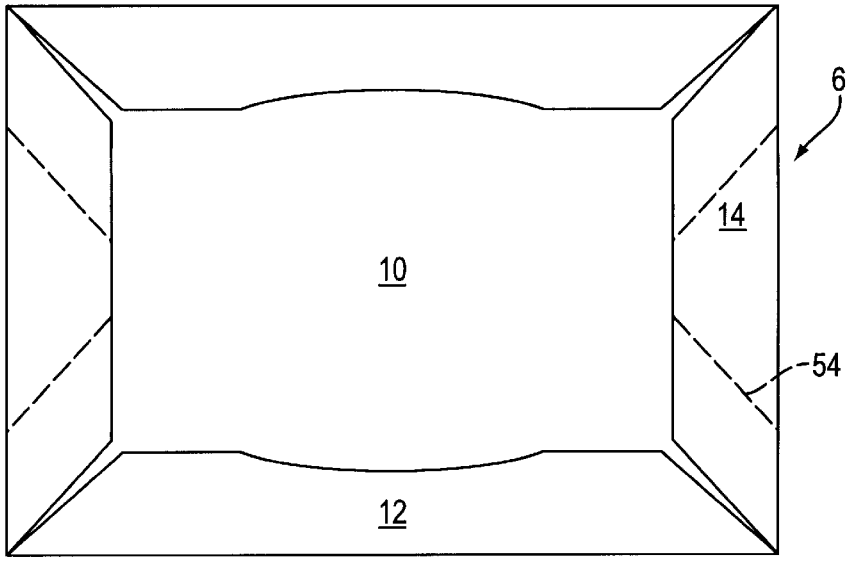
FIG. 5 is a plan view of the embodiment shown in FIG. 1.
Figure 6:
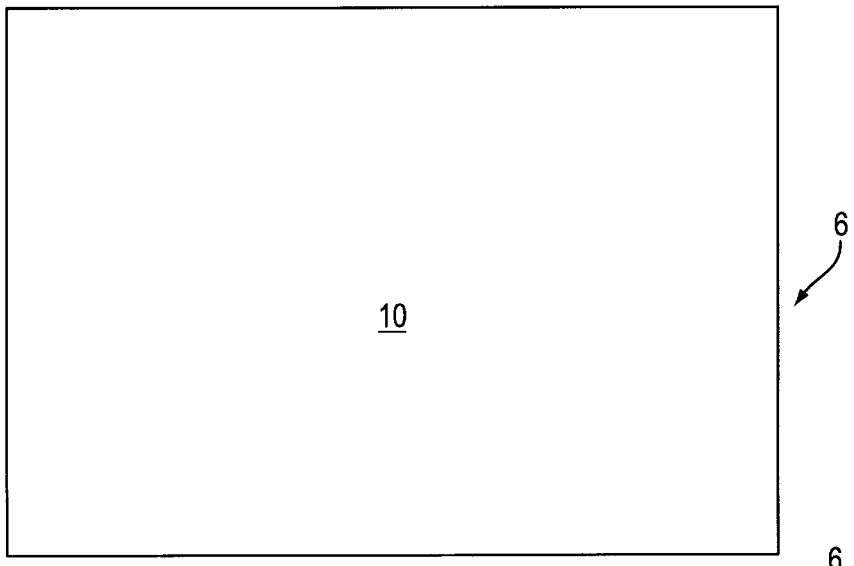
FIG. 6 is a bottom view of the embodiment shown in FIG. 1.
Figure 7:
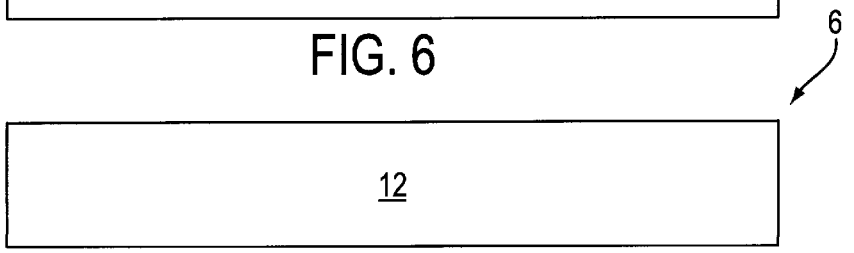
FIG. 7 is a front elevational view of the embodiment shown in FIG. 1.
Figure 8:
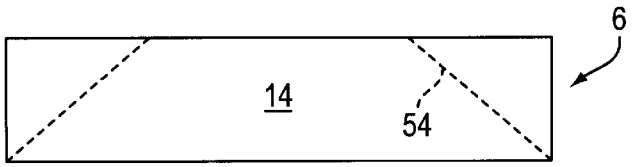
FIG. 8 is a side elevational view of the embodiment shown in FIG. 1.

Each side wall 12, 14 is located on and attached to a respective edge of the bottom 10. As best shown in FIGS. 2–4, the side walls of the assembled box 6 are generally upright, so as to form a receiving space 20 for accommodating the tray 22.

Each side wall 12, 14 has an upper edge 24, 26 with a flange 32, 34 attached thereto. The flanges 32, 34 are arranged in the assembled box to project down toward the rectangular bottom 10.

As shown, the respective side walls are connected together using drag flaps 42. The drag flaps 42 are integrally formed with a respective one side wall of the box 6, and form an extension of the respective side wall.

When the box 6 is assembled, the side walls 12, 14 are folded, such as in the direction A, to project transversely to the rectangular bottom 10. The drag flaps 42 are next folded in a direction toward an adjacent side wall, and glued or otherwise fastened to the adjacent side wall. As is known in the art, the base 50 of the drag flaps abuts against the bottom 10 of the box when the box is assembled, so as to provide support for the box shape.

The box 6 preferably includes perforations or creases 54 within the end (short) side walls 14, which enable the assembled box to be folded flat (not shown) for transport purposes.

Typically, the tray 22 (shown upside down in FIGS. 3 and 4) includes a base 58, and a circumferentially arranged, upright side 62. At an upper edge of the tray 22 is a flat flange 66 that is arranged essentially parallel to the base of the tray. However, other shaped tray flanges may also be used, such as rounded tray flanges (not shown), without departing from the spirit and scope of the invention. Further, although the tray shown has an essentially rectangular shape, other shaped trays may also be used, such as circular-shaped trays.

The trays typically have a stacking ring 70 extending around the circumference of the tray, located on the upright side 62, and immediately below the tray flange 66. The stacking ring 70 causes two trays stacked on top of one another to have a small space between their flanges, so that the tray can be easily separated. Such stacking rings are known.

To insert the associated tray 22 within the protective box 6, the tray is turned upside down (as best shown in FIG. 3), so that the tray flange 66 is facing the rectangular bottom 10 of the box. As shown, the upside down tray 22 is pushed into the receiving space 20 of the box 6, until it snaps in place. In this position, the flanges 32, 34 lock the tray 22 in location, by engaging the side 62 of the tray. Thus, the tray flange 66 is prevented from coming in contact with the sides walls 12, 14 of the box by the associated flanges 32, 34 of the box.

Preferably, the flanges 32, 34 of the box engage with the stacking ring 70 of the tray to hold the tray in position, and to minimize movement of the tray in and out of the receiving space 20.

As illustrated in the figures, the edges of the flanges that engage with the tray can be provided with a profile that corresponds to a profile of the sidewall of the tray. For example, in FIG. 3, the tray 22 is shown having a curved wall along its length, and a straight wall along its width. Correspondingly, the long flanges 32 of the box are provided with a curved edge that engages with the curved sidewall of the tray, and the short flanges 34 are provided with an essentially straight edge that engages with the straight sidewall of the tray, so as to as to provide the maximum contact between the flanges 32, 34 and the tray 22.

As is apparent from the figures, this box 6 additionally has an ornamental appearance that is aesthetically pleasing.

Referring generally to FIGS. 9–14, a second embodiment of the present invention is shown. The protective box 74 is formed by a rectangular bottom 76 and top 78, and four side walls. As shown, two oppositely located side walls 80, 80' have a length that is greater than a length of the other two oppositely located side walls 82.

Figure 9:
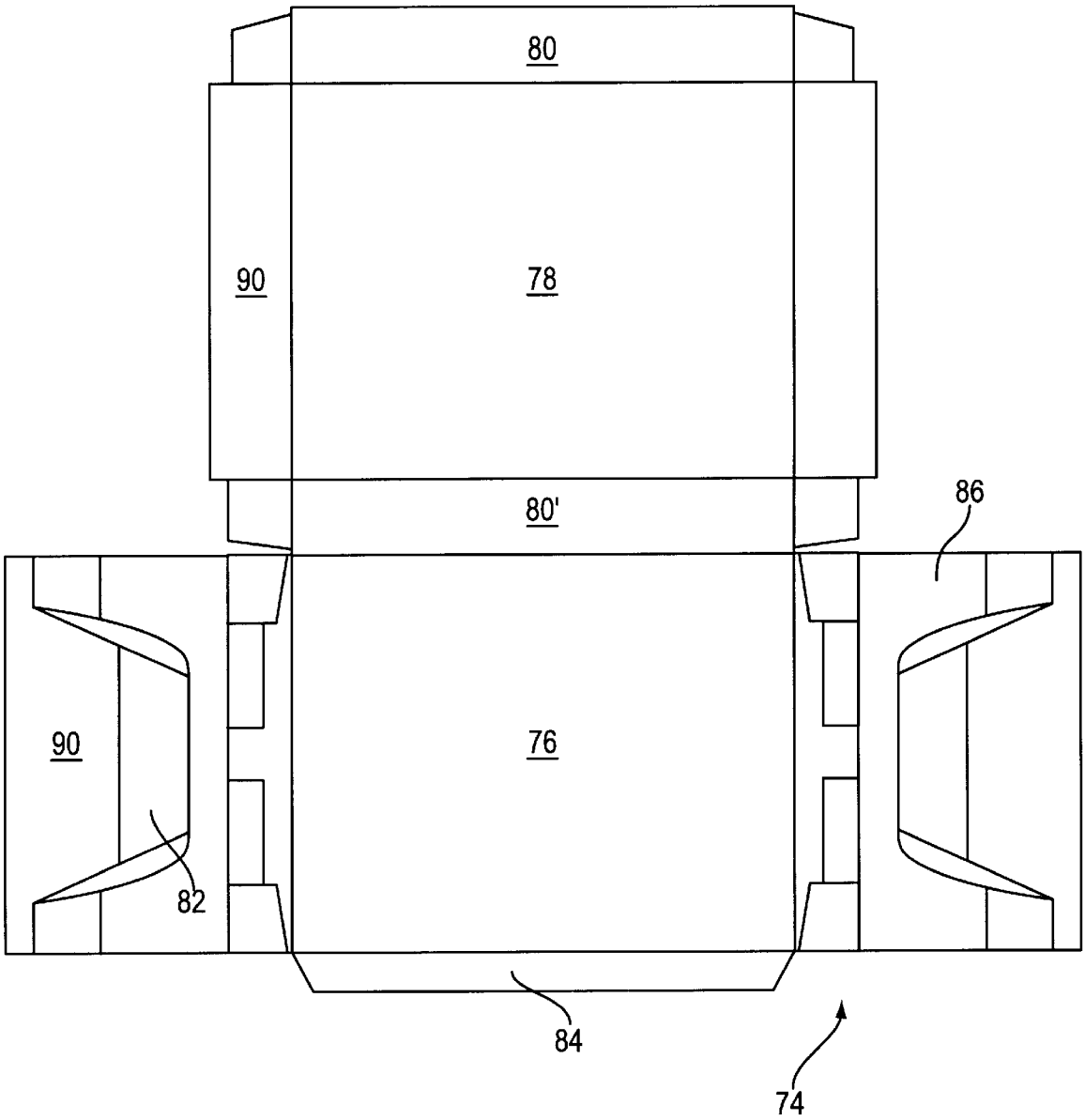
FIG. 9 illustrates a second embodiment of the present invention, with the protective box being shown in its unassembled condition.
Figure 10:
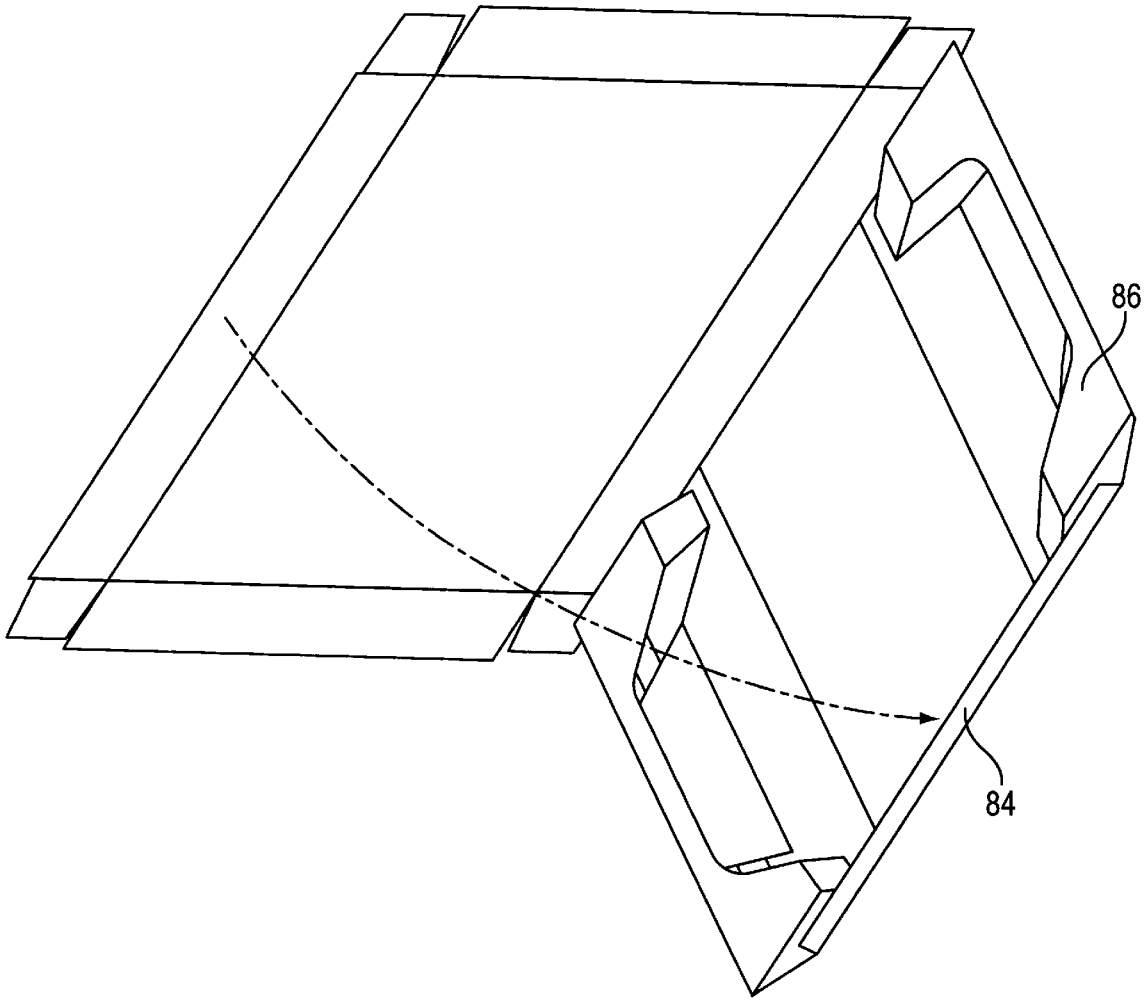
FIG. 10 is a perspective illustration of the embodiment shown in FIG. 9, with the protective box in a partially assembled condition.

In the unassembled condition shown in FIG. 9, the side walls 80, 80' of box 74 are located on and attached to opposite edges of the top 78. Further, one of the side walls 80' is additionally connected to an edge of the bottom 76, so as to connect the bottom 76 with the top 78.

Figure 11:
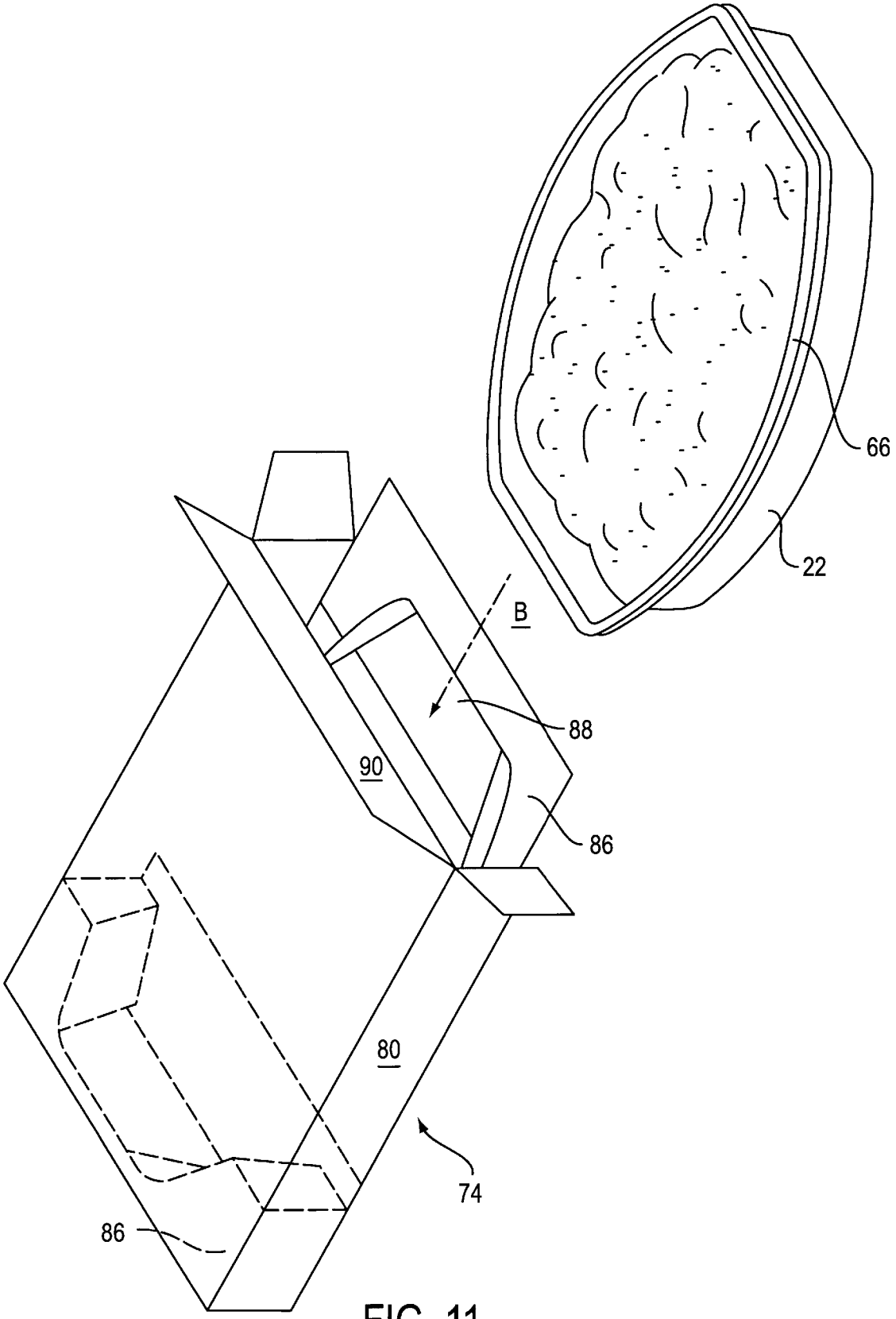
FIG. 11 is a perspective illustration of the embodiment shown in FIG. 9, with the partially assembled protective box being used in conjunction with a food tray.
Figure 12:
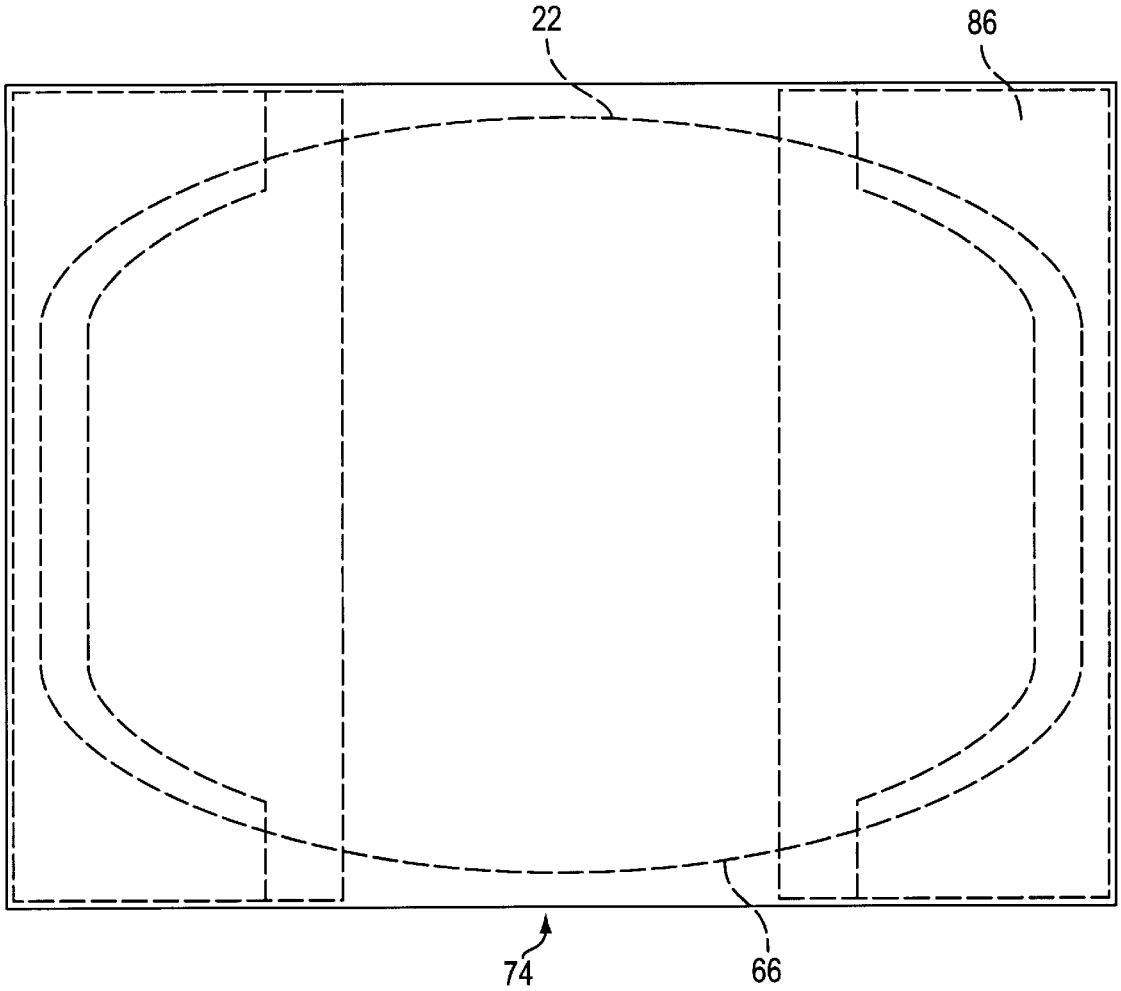
FIG. 12 is a plan view of the embodiment shown in FIG. 9, with the tray being shown in hidden lines.
Figure 13:
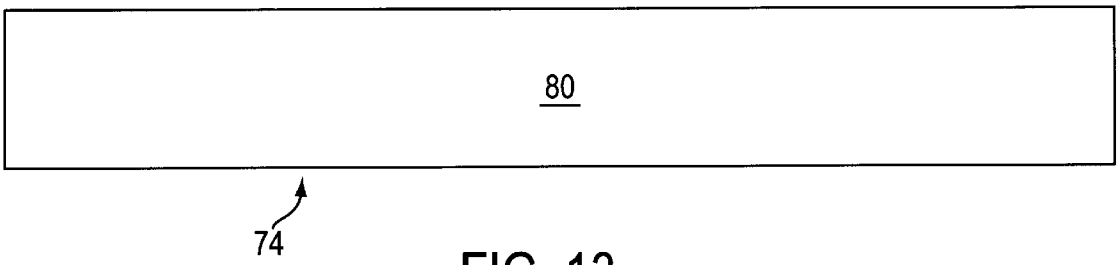
FIG. 13 is a front elevational view of the embodiment shown in FIG. 9.
Figure 14:
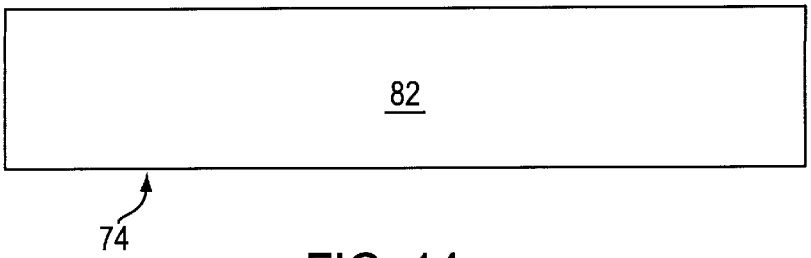
FIG. 14 is a side elevational view of the embodiment shown in FIG. 9.

The bottom 76 additionally includes a flap 84 that extends the length of the box, and is connectable to the side wall 80, so as to form an open ended box, such as shown in FIG. 11.

Each side wall 82 of the box includes a pop-up block flange 86. When the box is assembled, the block flange 86, which had been laid flat, is popped-up into position for accommodating the tray 22, as will be subsequently described.

The block flange 86 preferably has a recess or cut-out portion 88 with the shape of the tray 22, so that once the tray is inserted, the block flange 86 wraps around the ends of the tray. The edges of the cut-out portion are shaped so as to correspond to the shape of the tray, and will securely engage with the sides of the tray, thus preventing the tray flange 66 from engaging with any of the side walls of the box.

As shown, the side walls 82 may be provided with flaps 90. Preferably, the food tray 22 is inserted into the box 74 through one of the open ends of the box, and in the direction of arrow B. Once the tray is in position, the block flanges 86 are popped-up into position. Thereafter, the flaps 90 are folded down and sealed, thus retaining the block flanges 86, and the tray 22, in position.

Instead of cut-out portions 88, the block flanges 86 can be straight block flanges, i.e., having no cut-out portion formed therein. If straight block flanges are used, this embodiment provides the necessary buffer along only the two short sides of the box and tray. However, it has been discovered through extensive abuse testing that it is along these sides that most of the breakage occurs. Thus, this embodiment will eliminate much more than half of all breakage that may occur on the market. Otherwise one block flange will be required on each side of the tray (not shown) to prevent the tray from moving within the box.

Of course, similar to the first embodiment, box 74 includes a plurality of drag flaps positioned in strategic positions, so as to provide support for the box shape.

As is apparent from the figures, this box additionally has an ornamental appearance that is aesthetically pleasing.

Referring to FIGS. 15–22, a third embodiment of the present invention is shown. The protective box 92 is formed by a bottom 94 and top 95, and four side walls. As shown, two oppositely located side walls 96, 96' have a length that is greater than a length of the other two oppositely located side walls 98.

Figure 15:
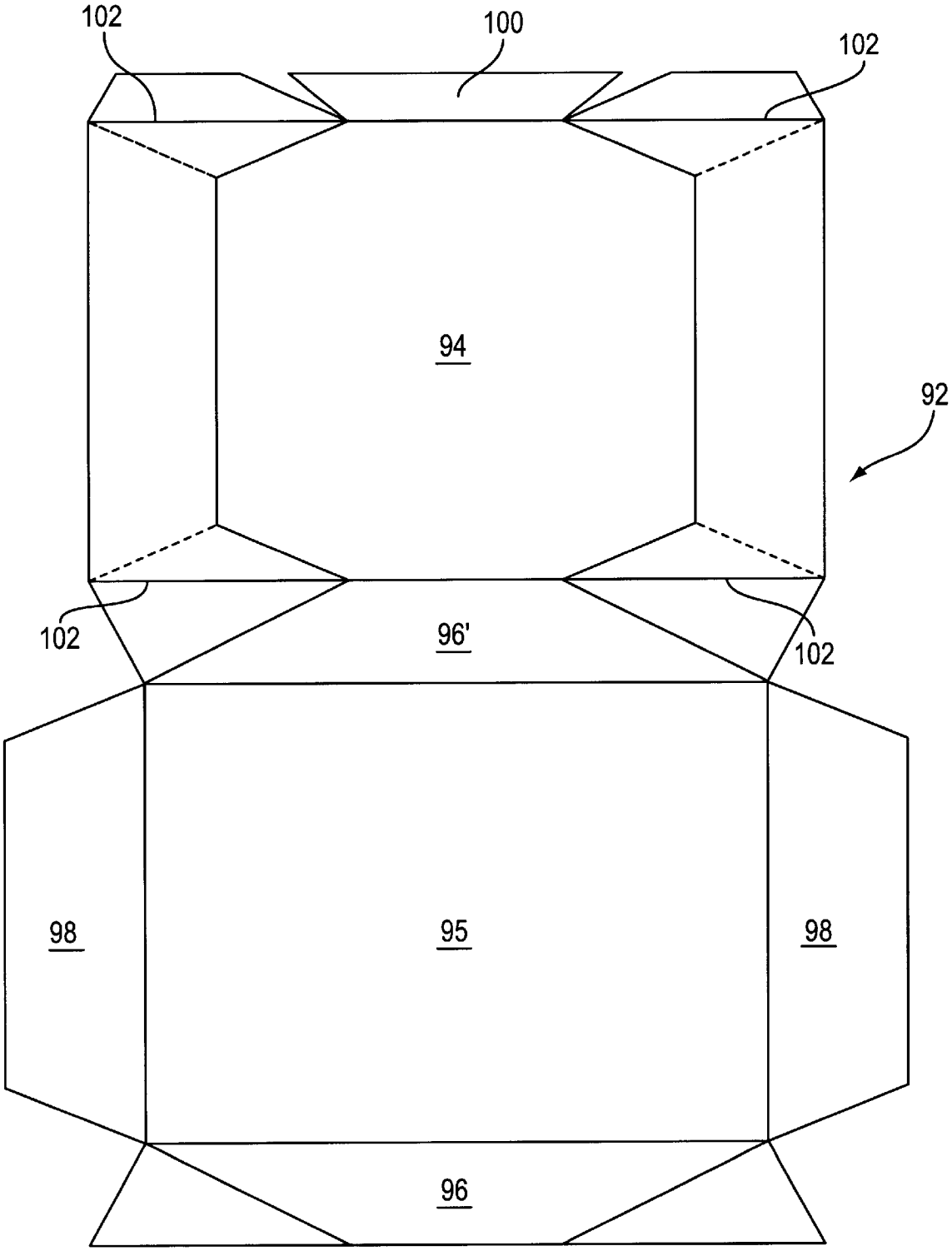
FIG. 15 illustrates a third embodiment of the present invention, with the protective box being shown in its unassembled condition.
Figure 16:
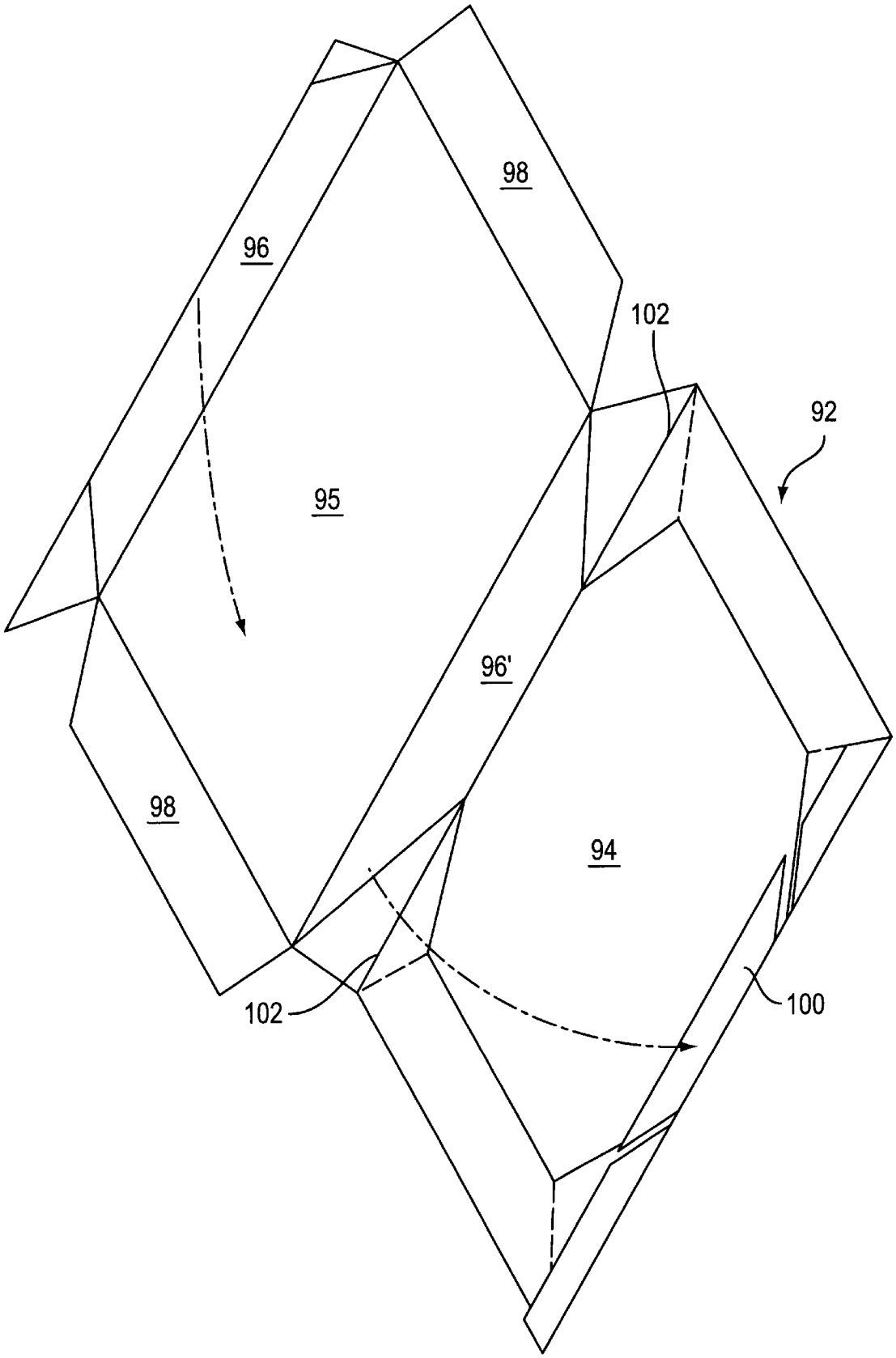
FIG. 16 is a perspective illustration of the embodiment shown in FIG. 15, with the protective box in a partially assembled condition.

In the unassembled condition shown in FIG. 15, the side walls 96, 96' of box 92 are located on and attached to opposite edges of the top 95. Further, one of the side walls 96' is additionally connected to an edge of the bottom 94, so as to connect the bottom 94 with the top 95. In FIGS. 15 and 16, cut lines are indicated as dashed lines.

Figure 17:
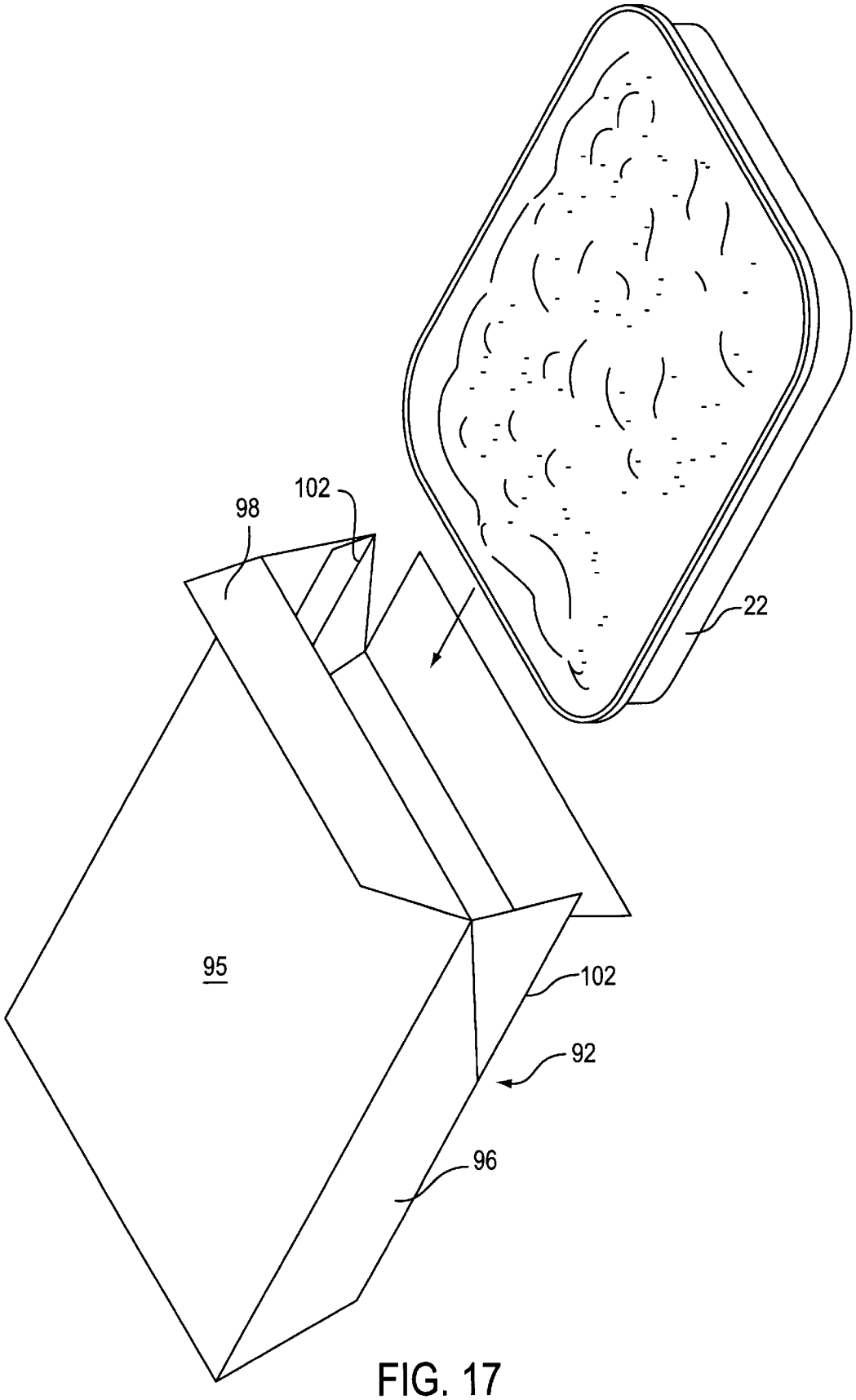
FIG. 17 is a perspective illustration of the embodiment shown in FIG. 15, with the assembled protective box being used in conjunction with a food tray.
Figure 19:
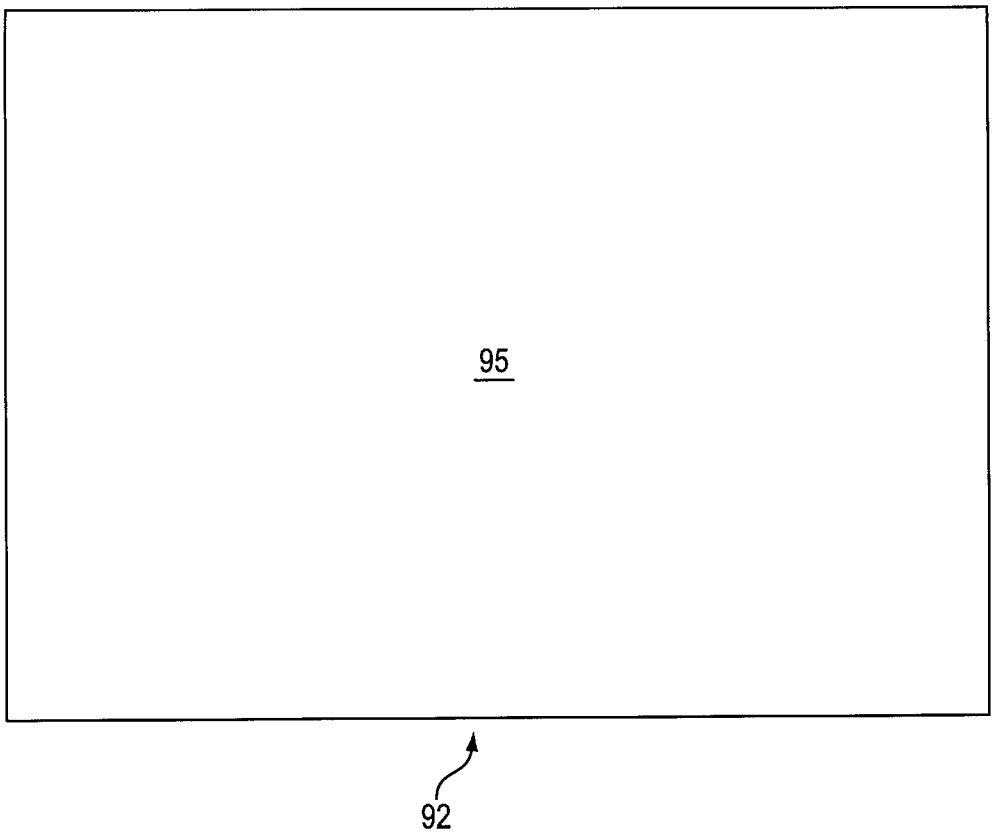
FIG. 19 is a top view of the embodiment shown in FIG. 15.
Figure 18:
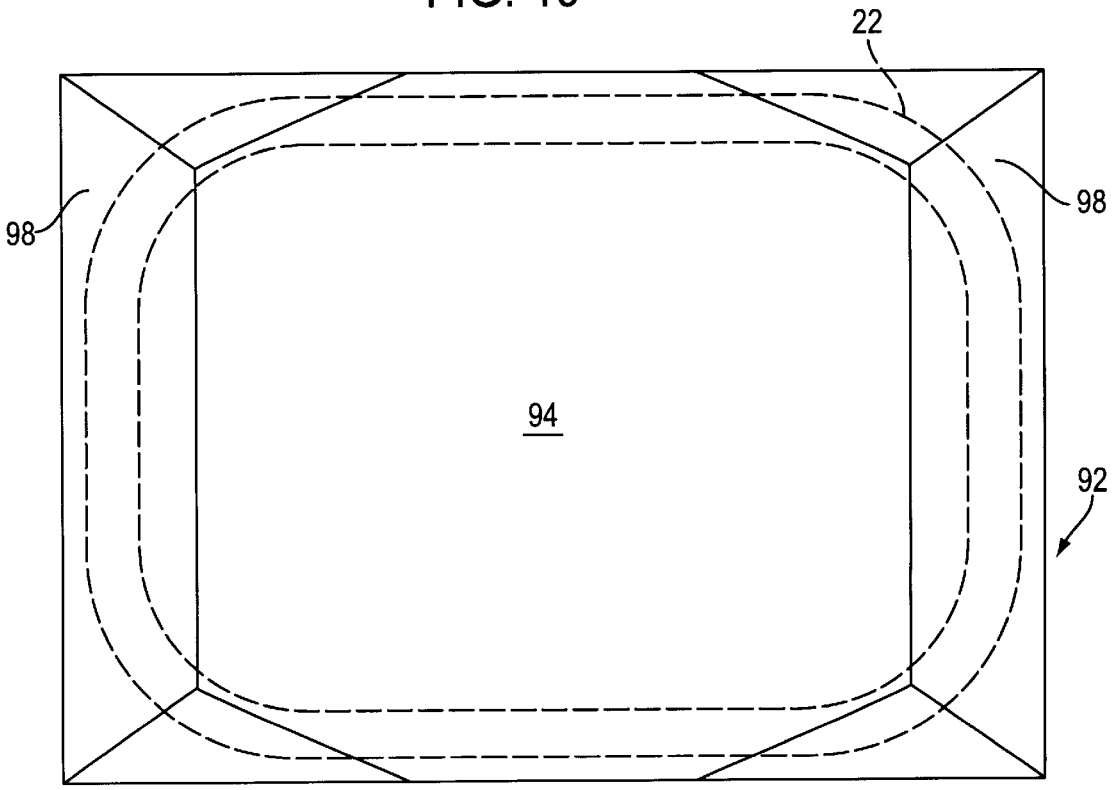
FIG. 18 is a plan view of the embodiment shown in FIG. 15, with the tray being shown in hidden lines.

The bottom 94 additionally includes a flap 100 that is connectable to the side wall 96, so as to form an open ended box, such as shown in FIG. 17.

In this embodiment, the four corners 102 of the box act as a protector for the tray flange, so that the tray body abuts up against the corners themselves. To accomplish this, the corners 102 are angled inward towards the interior of the box. Thus, when the tray 22 is inserted into the box, the sides of the tray abut up against the corners or corner segments 102, so that the corners cushion the flange 66 on all four sides of the tray by keeping the flange entirely free of the edges of the box along all four sides.

Figure 20:
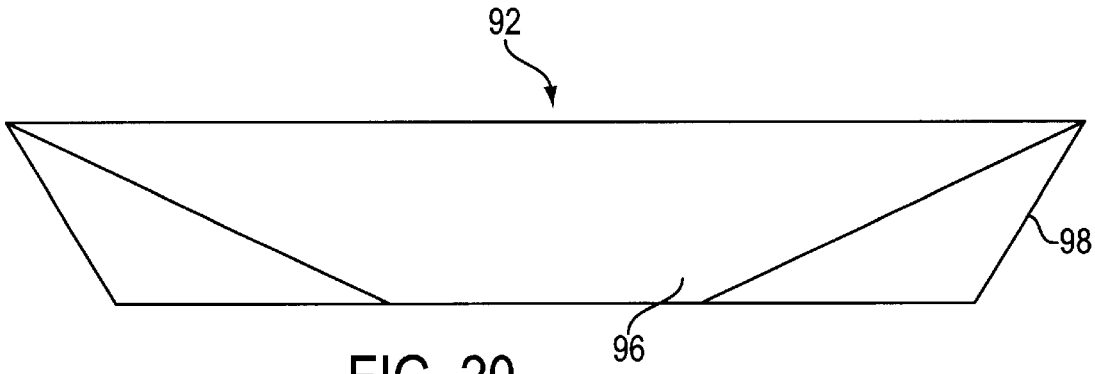
FIG. 20 is a front elevational view of the embodiment shown in FIG. 15.
Figure 21:
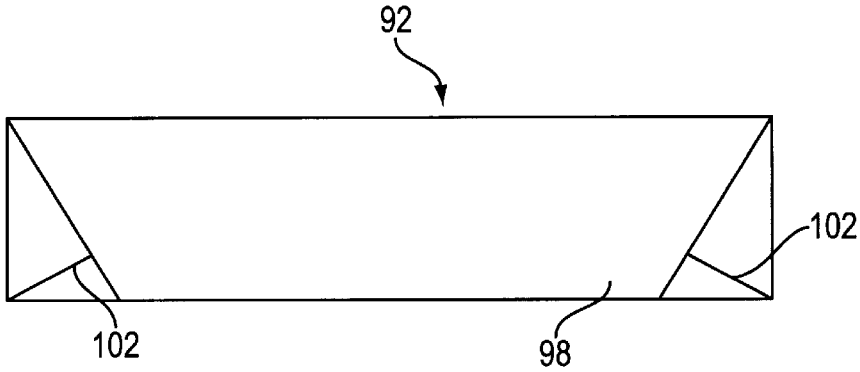
FIG. 21 is a side elevational view of the embodiment shown in FIG. 15.
Figure 22:
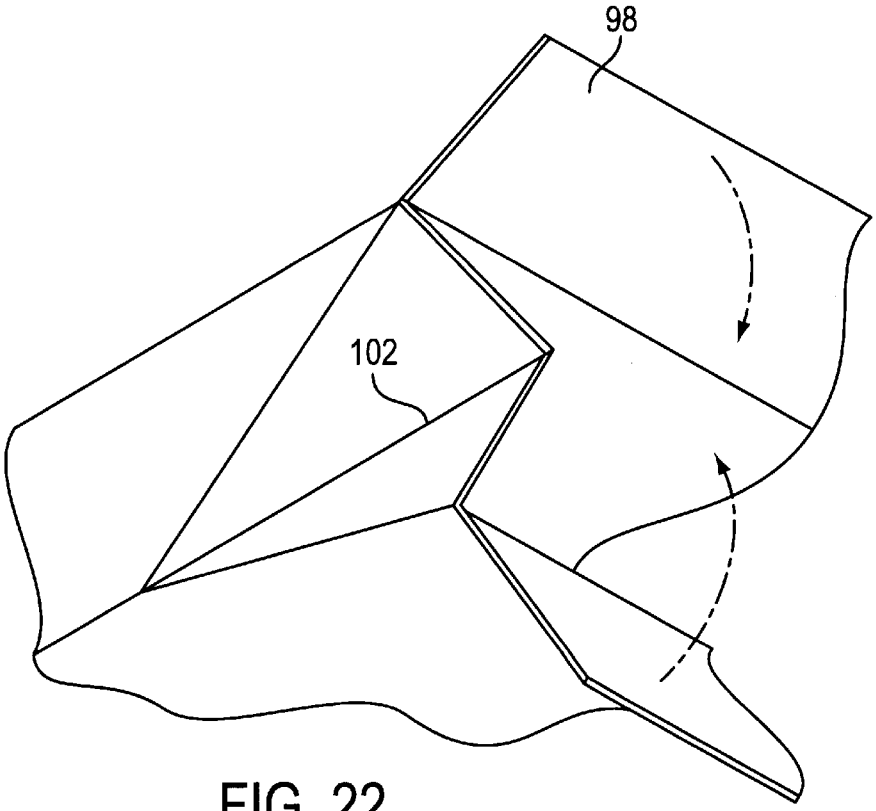
FIG. 22 is an exploded partial view of the embodiment shown in FIG. 15, illustrating the corners of the box.

As best shown in FIG. 20, preferably the side walls 98 of the box are angled inward, from the top 95 toward the bottom 94. As is apparent from this figure, this requires that the bottom 94 have a shorter length than the top 95. By angling the walls in this manner, the angled walls 98 engage with the sides of the tray, thus providing additional support to the walls of the tray.

As is apparent from the figures, this box additionally has an ornamental appearance that is aesthetically pleasing.

Referring to FIGS. 23–27, a fourth embodiment of the present invention is shown. The protective box 104 is formed by a bottom 106 and top 108, and four side walls. As shown, two oppositely located side walls 110, 110' have a length that is greater than a length of the other two oppositely located side walls 112.

Figure 23:
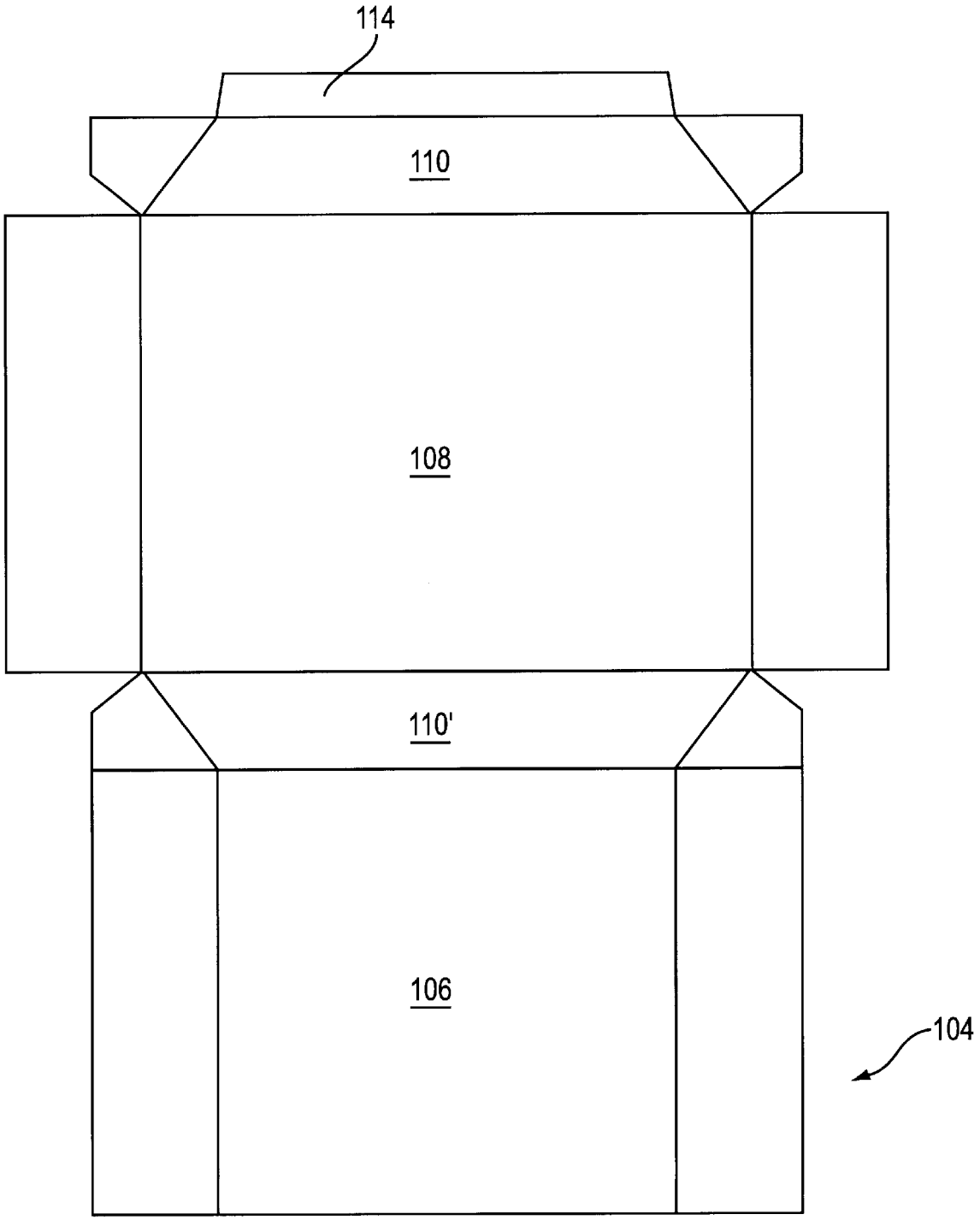
FIG. 23 illustrates a fourth embodiment of the present invention, with the protective box being shown in its unassembled condition.
Figure 24:
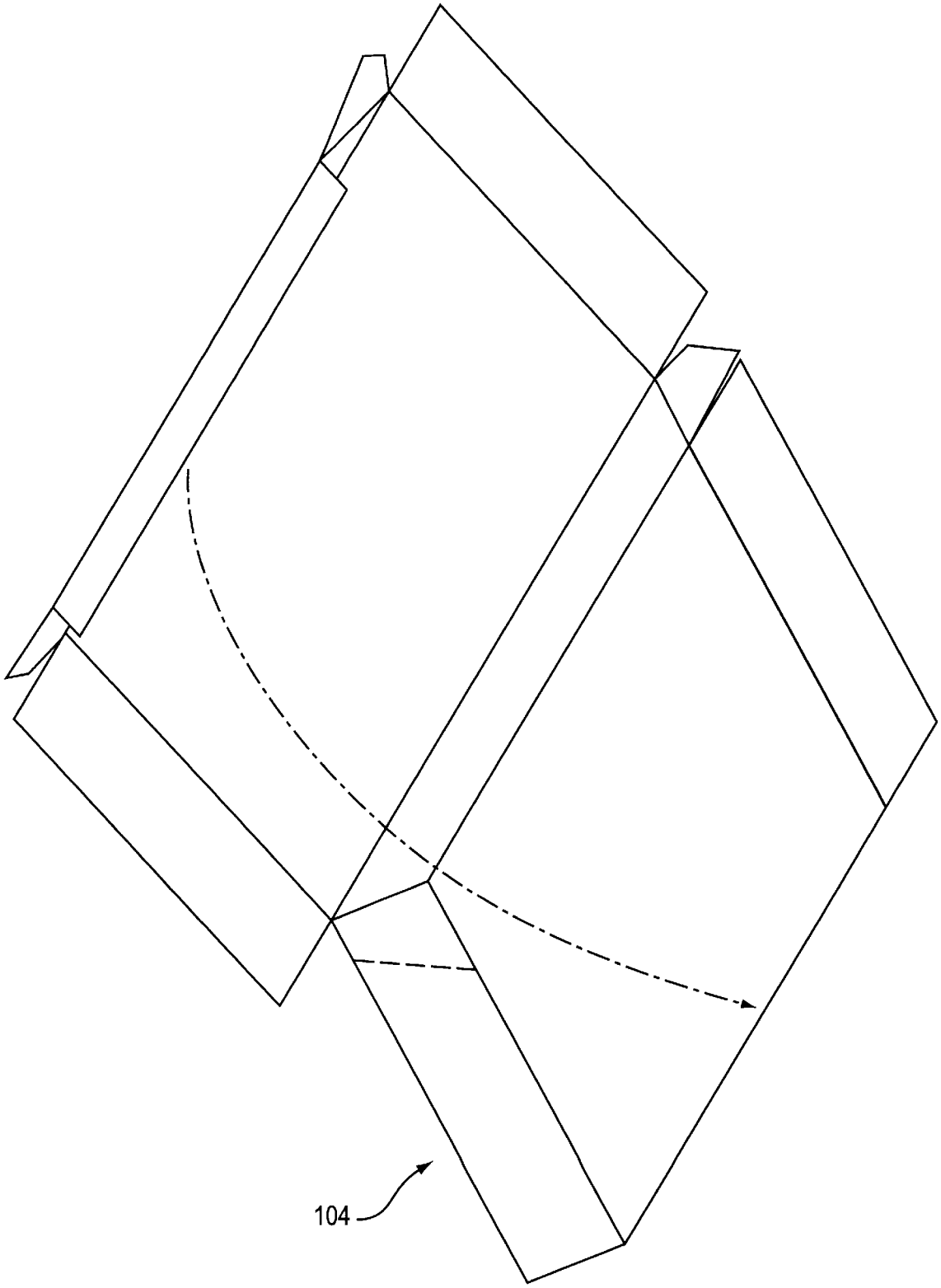
FIG. 24 is a perspective illustration of the embodiment shown in FIG. 23, with the protective box in a partially assembled condition.

In the unassembled condition shown in FIG. 23, the side walls 110, 110' of box 104 are located on and attached to opposite edges of the top 108. Further, one of the side walls 110' is additionally connected to an edge of the bottom 106, so as to connect the bottom 106 with the top 108.

Figure 25:
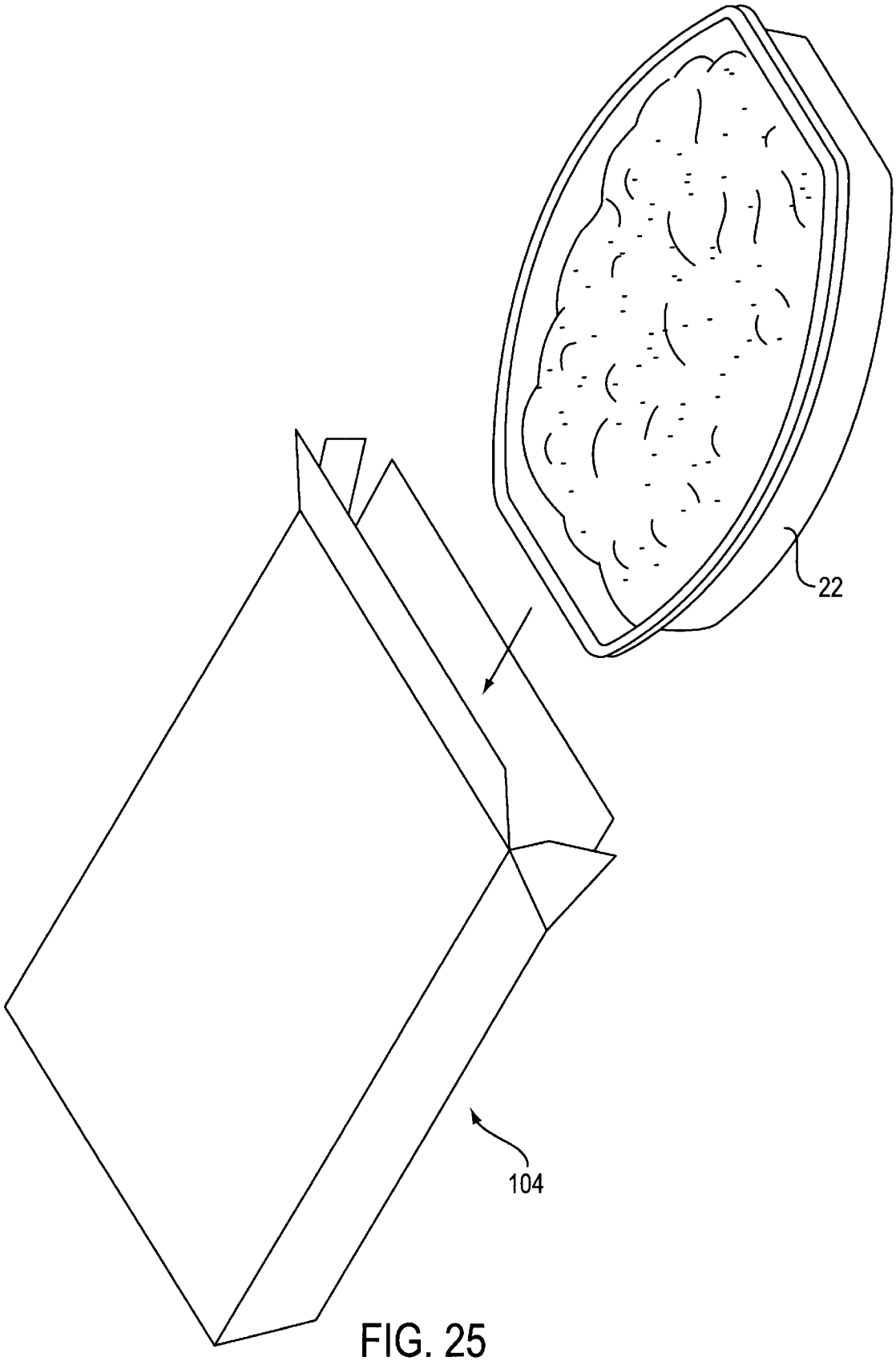
FIG. 25 is a perspective illustration of the embodiment shown in FIG. 23, with the assembled protective box being used in conjunction with a food tray.
Figure 26:
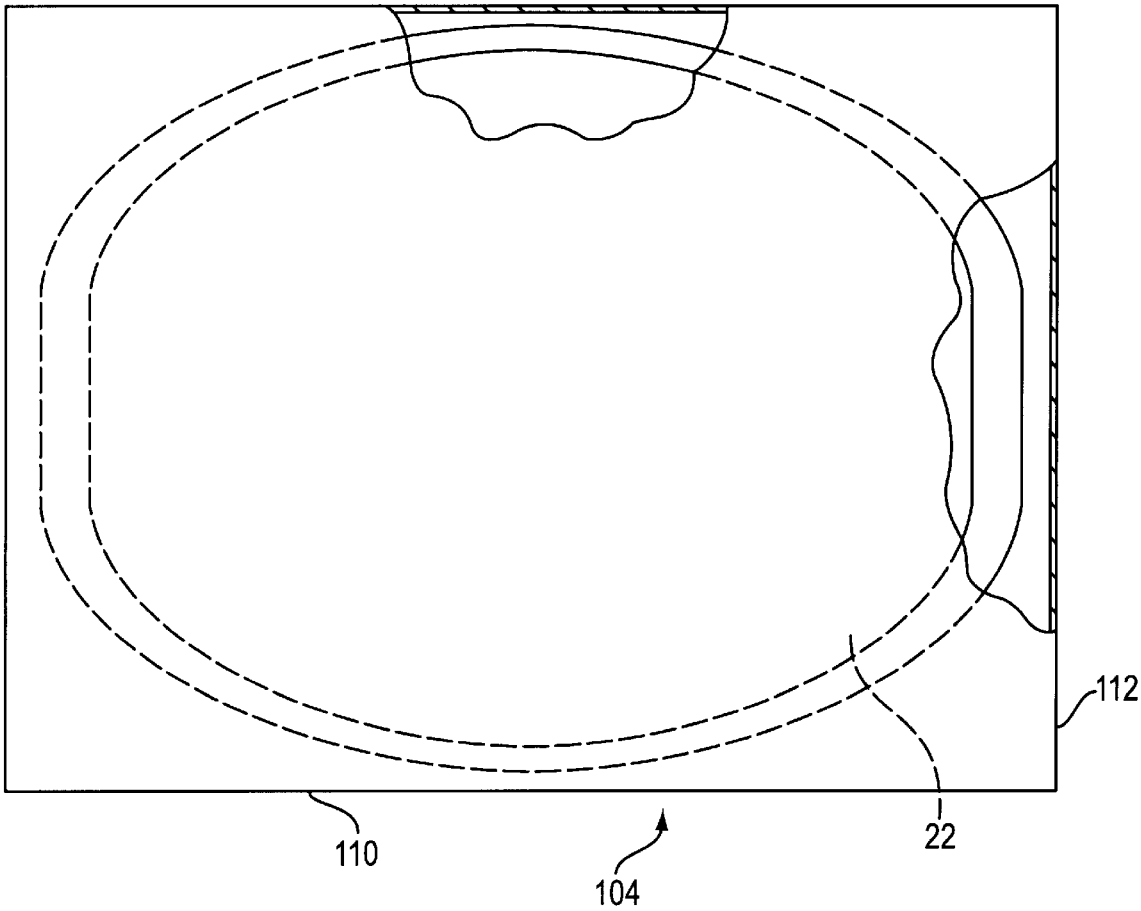
FIG. 26 is a plan view of the embodiment shown in FIG. 23, with the tray being shown in hidden lines.

The sidewall 110 additionally includes a flap 114 that is connectable to the bottom 106, so as to form an open ended box, such as shown in FIG. 25.

Figure 27:
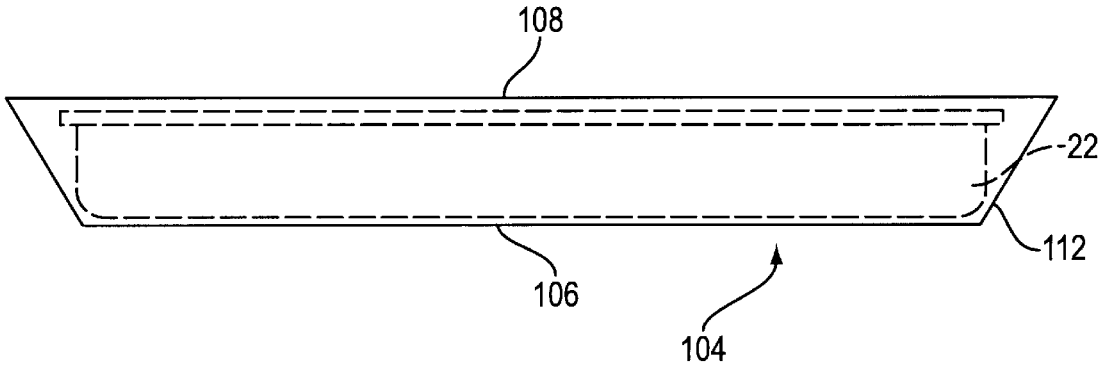
FIG. 27 is an elevational view of the embodiment shown in FIG. 23.

In this embodiment, and as best shown in FIG. 27, the side walls 112 of the box are angled inward, from the top 108 toward the bottom 106. As is apparent from this figure, this requires that the bottom 106 have a shorter length than the top 108. By angling the walls in this manner, the angled walls 112 engage with the sides of the tray, thus preventing the flange along the short end of the tray from coming in contact with the walls 112 of the box.

Thus, the resulting box has a trapezoidal shape, and provides protection on two sides of the tray. The angle of inclination is selected so that the base of the tray, when the tray is inserted, abuts up against the end walls 112, so as to provide the necessary buffer between the end walls and the tray flange 66. It is also possible for the box to have four tapered sides such that the box provides protection on all sides of the tray. Such a box would be trapezoidal on both the long and short sides.

As is apparent, this embodiment provides the necessary buffer along only the two short sides of the box and tray. However, it has been discovered through extensive abuse testing that it is along these sides that most of the breakage occurs. Thus, this embodiment will eliminate much more than half of all breakage that may occur on the market.

Advantageously, the box flanges of all embodiments form an integral component of the box. Thus, the box, together with the box flanges, can be easily manufactured by stamping the box and box flanges out of a single blank. The box can thus be easily stored, and readily assembled.

Although the above embodiments have been directed to essentially rectangular-shaped boxes, other shapes may also be used, such as triangular or round boxes, without departing from the scope of the invention. Additionally, boxes having more than four upright walls could be used, as long as the resulting box includes means for separating a flange of the tray from at least some of the walls of the box.

Through abusive testing, the above-described protective boxes have been demonstrated to reduce breakage of the tray flange along the short side of the tray from 90%, using the known box, to about 0%. Further, the embodiment of the present invention that provides additional protection along the long sides of the tray has been shown to reduce breakage of the flange on the long side from about 10%, using the known box, to about 0%.

EXAMPLES

Three different customer specific tray designs in boxes according to the present invention were compared to standard sealed end boxes as follows. Trays were filled with starch solution to appropriate food weight, sealed with a film lid and placed in individual paperboard cartons. The cartons were then frozen for 24 hours at −20° F. The cartons were dropped on a vertical slide from a given height onto concrete, which was repeated for all four sides. Results were calculated as total broken sides per total drops.

| Carton Design | Tray Design[1] | Drop ht(") | Breakage Reduction short side[2] | Breakage Reduction long side[2] |
|---|---|---|---|---|
| trapezoidal on two short sides 4th embodiment | A | 24 | 82% to 0% | 9% to 4% |
| flange block w/ tray-shaped cut-out on two short sides; 2nd embodiment | A | 24 | 82% to 0% | 9% to 0% |
| flange block, no cut-out; 2nd embodiment | A | 24 | 82% to 0% | 9% to 4% |
| flange block, no cut-out; 2nd embodiment | B | 36 | 70% to 0% | 70% to 0% |
| 3rd embodiment | C | 24 | 78% to 0% | 58% to 0% |

[1] A: Generally oval with handles on both short sides B: Generally oval C: Generally rectangular

[2] % breakage observed for standard control compared to % breakage observed for boxes according to the present invention The invention now being fully described, it will be apparent to one of ordinary skill in the art that any changes and modifications can be made thereto without departing from the spirit or scope of the invention, as defined in the appended claims.

What is claimed is:

1. A protective box for a food tray having a circumferentially arranged flange, comprising:

a base;

at least three, generally upright walls attached to said base, said walls forming a tray-receiving space;

means for holding the food tray within the tray receiving space so that the flange of the food tray is separated from said walls; and a second base;

wherein a first wall of said walls has a first side attached to said base, a second side attached to said second base, and a third side; and wherein said means for holding comprises: a first segment having a first side attached to the third side of said first wall and a second side; and a second segment having a first side attached to said second base and a second side attached to the second side of said first segment.

2. The box according to claim 1, wherein the means for holding comprises a plurality of corner segments adapted to be angled inward toward an interior of the box in an assembled state thereof for cushioning the flange of the food tray.

3. An assembly, comprising:

a food tray having a base, a generally upright, contiguous wall attached to said base, and a circumferential flange attached to an upper end of the wall; and a protective box having a base, at least three generally upright walls attached to the base of said box, means for holding the food tray within said box so that the flange of said food tray is separated from the upright walls of said box, and a second base;

wherein a first wall of said walls of said box has a first side attached to said base, a second side attached to said second base, and a third side; and wherein said means for holding of said box comprises: a first segment having a first side attached to the third side of said first wall and a second side; and a second segment having a first side attached to said second base and a second side attached to the second side of said first segment.

* * * * *